US012416468B2

(12) United States Patent
Axelsson

(10) Patent No.: US 12,416,468 B2
(45) **Date of Patent: *Sep. 16, 2025**

(54) GAS-POWERED GUN

(71) Applicant: FX Airguns AB, Mariestad (SE)

(72) Inventor: Fredrik Axelsson, Mariestad (SE)

(73) Assignee: FX RnD AB, Mariestad (SE)

( * ) Notice: Subject to any disclaimer, the term of this patent is extended or adjusted under 35 U.S.C. 154(b) by 0 days.

This patent is subject to a terminal disclaimer.

(21) Appl. No.: 18/388,979

(22) Filed: Nov. 13, 2023

(65) Prior Publication Data

US 2024/0159492 A1 May 16, 2024

(30) Foreign Application Priority Data

Nov. 14, 2022 (EP) ..... 22207183

(51) Int. Cl.
*F41B 11/00* (2013.01)
*F41B 11/62* (2013.01)
*F41B 11/723* (2013.01)

(52) U.S. Cl.
CPC ..... *F41B 11/723* (2013.01); *F41B 11/62* (2013.01)

(58) Field of Classification Search
CPC ..... F41B 11/52; F41B 11/62; F41B 11/60; F41B 11/723; F41B 11/73
USPC ..... 124/50, 75
See application file for complete search history.

(56) References Cited

U.S. PATENT DOCUMENTS 2,634,717 A 4/1953 Junkin
4,951,644 A 8/1990 Bon
5,542,406 A 8/1996 Oneto
5,967,133 A 10/1999 Gardner, Jr.
6,349,711 B1 2/2002 Perry et al.
6,637,421 B2 10/2003 Smith et al.
6,644,295 B2 11/2003 Jones
6,644,296 B2 11/2003 Gardner, Jr.
6,675,791 B1 1/2004 Alexander et al.
6,889,681 B1 5/2005 Alexander et al.
7,044,119 B2 5/2006 Jones
7,237,544 B2 7/2007 Jones
7,461,646 B2 12/2008 Jones
7,556,032 B2 7/2009 Jones et al.
7,591,262 B2 9/2009 Jones et al.
7,617,819 B2 11/2009 Jones
7,624,723 B2 12/2009 Gardner, Jr. et al.
7,640,925 B2 1/2010 Jones
(Continued)

FOREIGN PATENT DOCUMENTS

EP 0140657 A1 5/1985
GB 2427671 A 1/2007

OTHER PUBLICATIONS

Extended European Search Report dated May 9, 2023 issued by the European Patent Office in corresponding European Patent Application No. 22207183.9 (7 Pages).
(Continued)

*Primary Examiner* — Michael D David
(74) *Attorney, Agent, or Firm* — Panitch Schwarze Belisario & Nadel LLP

(57) ABSTRACT

A gas-powered gun for discharge of projectiles, comprising a pressure chamber for holding compressed gas, a valve arranged to release compressed gas from the pressure chamber to thereby discharge a projectile provided in a barrel, and a plenum chamber in fluid connection with the pressure chamber. The plenum chamber is formed coaxially around a rear portion of the barrel.

20 Claims, 3 Drawing Sheets

(56) References Cited

U.S. PATENT DOCUMENTS

| | | | |
|---|---|---|---|
| 7,866,308 | B2 | 1/2011 | Jones et al. |
| 7,913,679 | B2 | 3/2011 | Quinn et al. |
| 8,082,912 | B2 | 12/2011 | Wood |
| 9,080,832 | B2 | 7/2015 | Brahler, II et al. |
| 9,649,897 | B2 | 5/2017 | Kunau |
| 9,700,779 | B1 | 7/2017 | Leal et al. |
| 10,266,019 | B2 | 4/2019 | Kunau |
| 10,800,216 | B2 | 10/2020 | Kunau |
| 11,079,037 | B2 | 8/2021 | Kunau |
| 11,273,677 | B2 | 3/2022 | Huang et al. |
| 2019/0107359 | A1 | 4/2019 | Rotrekl et al. |

OTHER PUBLICATIONS

Non-Final Office Action, issued Jun. 21, 2024, in U.S. Appl. No. 18/640,348, 14 pages.

GAS-POWERED GUN

FIELD OF THE INVENTION

The present invention relates to a gas-powered gun comprising a pressure chamber for holding compressed gas, a valve arranged to release compressed gas from the pressure chamber to thereby discharge a projectile provided in a barrel, and a plenum chamber in fluid connection with the pressure chamber.

BACKGROUND ART

Gas powered guns of the above-mentioned kind are well known in the art, and the compressed gas may be e.g., air (air guns). The size of the plenum is critical for the performance of the gun, and various add-on devices are available to provide an increased plenum size. However, such add-on plenum devices tend to be impractical.

SUMMARY OF THE INVENTION

In view of that stated above, the object of the present invention is to provide a gas-powered gun with an improved plenum size.

This and other objects are achieved by a gas-powered gun of the kind mentioned above, wherein the plenum chamber is formed coaxially around a rear portion of the barrel.

Such an arrangement of the plenum allows an increased plenum size without requiring any additional components or increasing the size of the gun.

The plenum may be formed by a sleeve arranged coaxially around the barrel, and provided with sealings in either end (front and rear). The rear sealing can then be provided with a passage for connecting the plenum with the pressure chamber.

It is noted that sleeves arranged coaxially around the barrel of a gun are known per se. Conventionally, such sleeves are provided to protect a user from the barrel, which may become very hot during use. Such conventional sleeves are however not sealed, and are also not designed to withstand high pressure.

BRIEF DESCRIPTION OF THE DRAWINGS

Currently preferred embodiments of the present invention will be described herein with reference to the following figures.

The invention may, however, be embodied in many different forms and should not be construed as limited to the embodiments set forth herein; rather, these embodiments are provided for thoroughness and completeness, and fully convey the scope of the invention to the skilled person. All the figures are highly schematic, not necessarily to scale, and they show only parts which are necessary in order to elucidate the invention, other parts being omitted or merely suggested.

DETAILED DESCRIPTION OF CURRENTLY PREFERRED EMBODIMENTS

Figure 1:
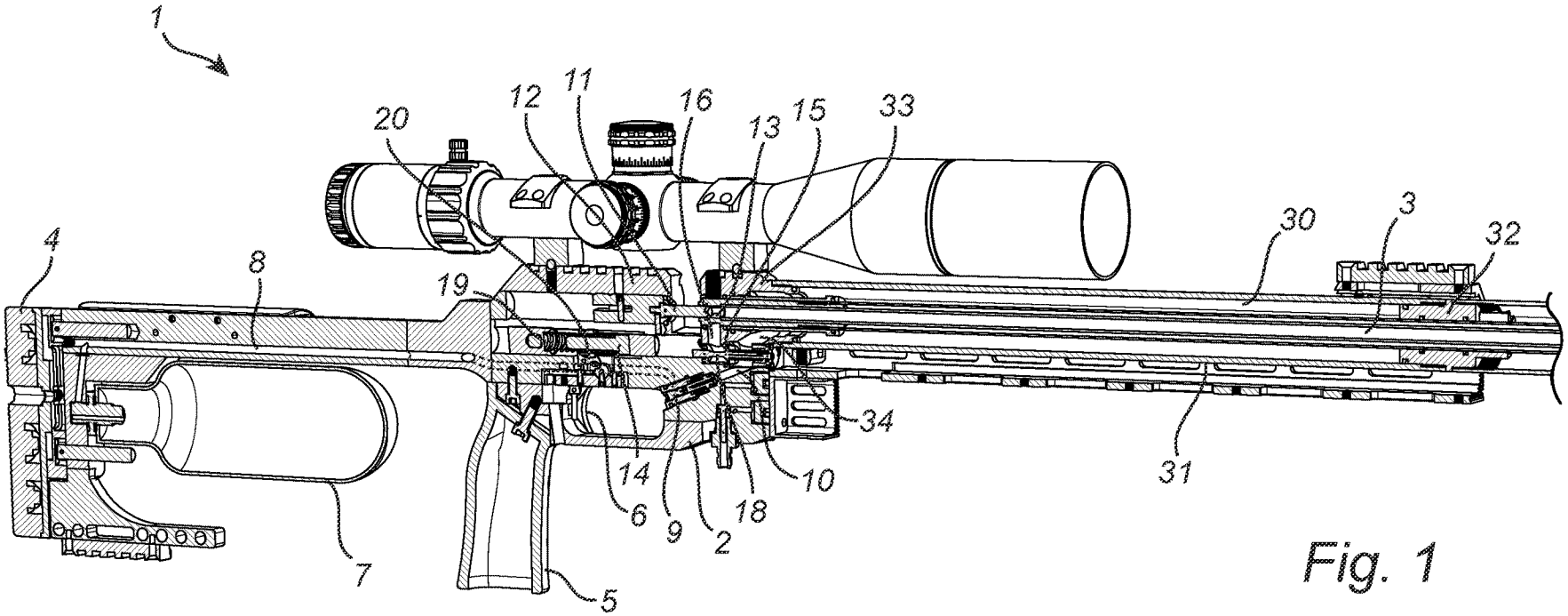
FIG. 1 shows an air gun according to an embodiment of the present invention.
Figure 2A:
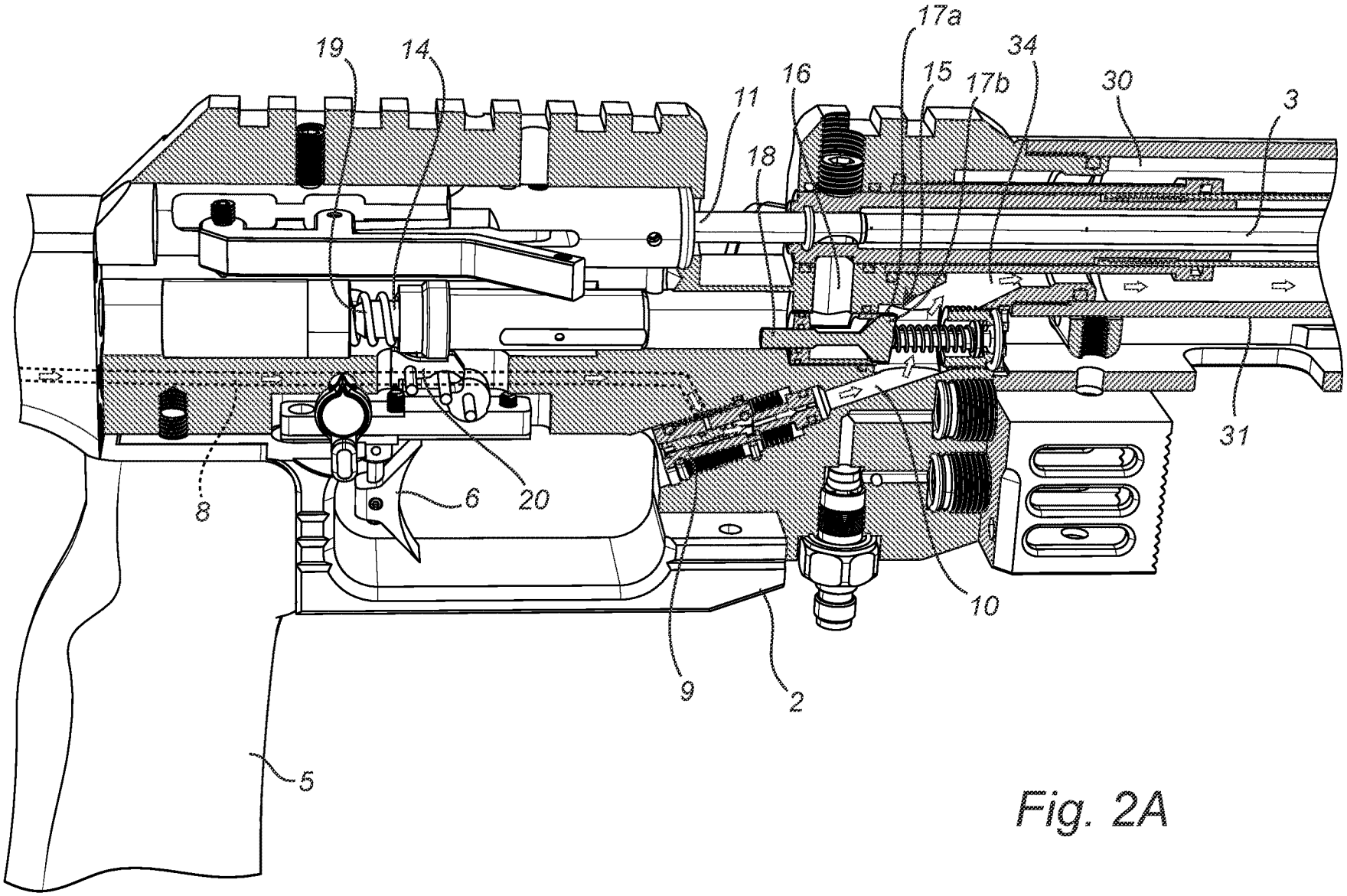
FIG. 2A-2B shows the gun in FIG. 1 in a loaded, ready-to-fire state and in a state of firing.
Figure 2B:
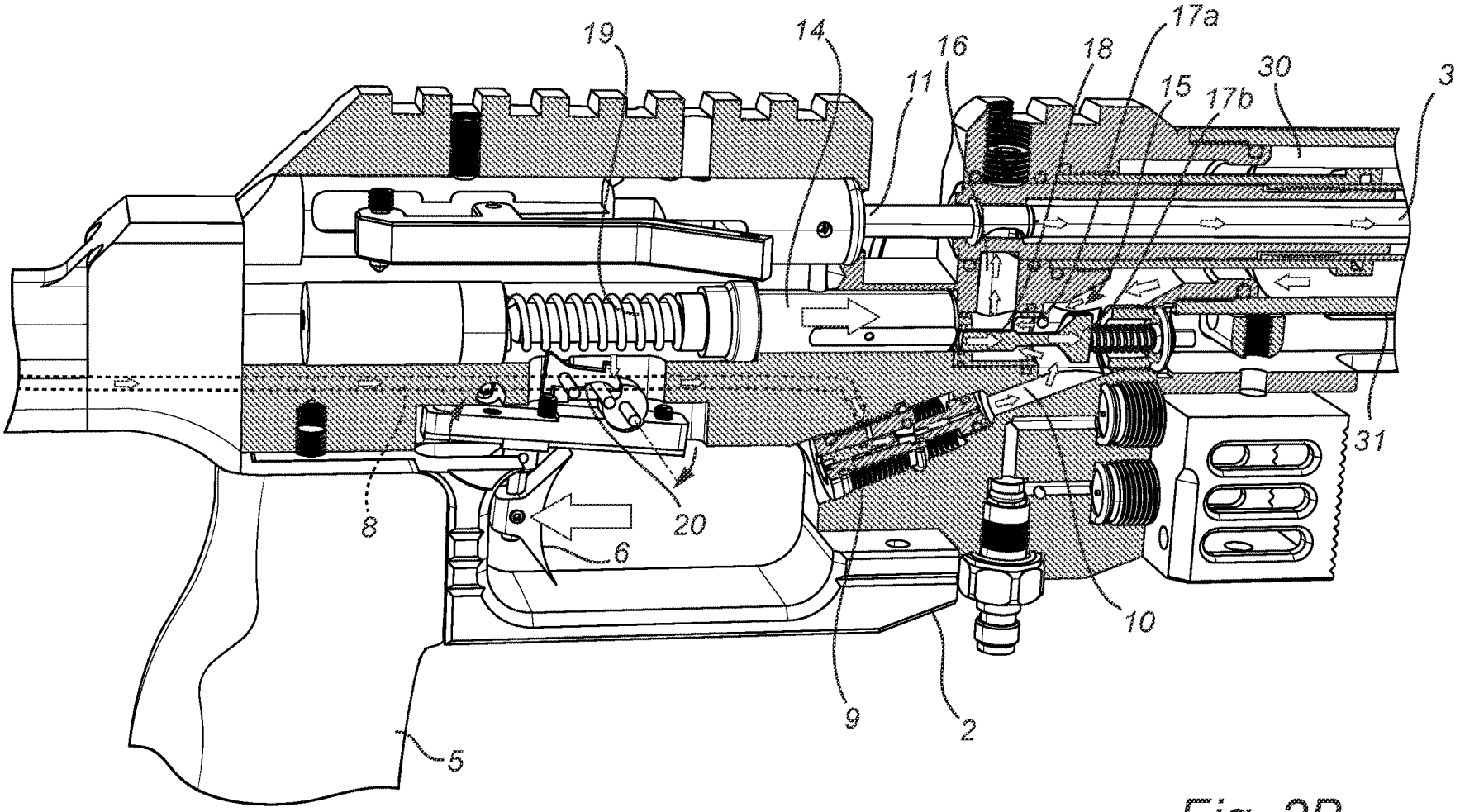

FIGS. 1 and 2A-2B show a gas-powered gun 1, generally including a body 2, a barrel 3, a stock 4 and a handle 5 with a trigger 6. The gun 1 is of the kind where a bottle 7 of compressed gas, such as air, is fitted to the gun 1. In the illustrated example the bottle 7 is fitted to the stock 4, but it may also be fitted to the body 2, in front of the handle.

Via a channel 8 and a pressure regulator 9 the bottle 7 is in fluid connection with a pressure chamber 10. The pressure regulator 9 ensures a controlled pressure in the pressure chamber 10 (regulated pressure).

The gun 1 further comprises a feeder pin 11 slidably arranged in a housing 12 behind the barrel 3. The feeder pin 11 is arranged to be slid back, thereby allowing a bullet (projectile) 13 to be inserted in a space in front of the feeder pin 11. The feeder pin 11 is then slid forward, thereby pushing the bullet 13 into a firing position in the barrel 3, as shown in FIG. 2A. The bullet 13 may be provided manually, or from some type of cartridge or magazine (not shown).

The trigger 6 is mechanically connected to a spring-loaded hammer 14, which operates an open-close valve 15, which connects the pressure chamber 10 to a space 16 immediately behind the bullet. The valve 15 includes a valve-seat 17*a* forming an opening of the pressure chamber 10, and a valve-head 17*b* arranged inside the pressure chamber and being pressed against the valve-seat 16 to seal the chamber 10. The valve-head 17*a* has a hammer cooperating portion 18 extending rear-wards through the opening, so that it can be engaged by the hammer 14.

When the gun is in a loaded position (FIG. 2A) the hammer 14 is biased towards the valve 15 by a biasing spring 19, and is held against the force of the biasing spring 19 by a catch 20. At the moment of firing (FIG. 2B), the trigger 6 releases the catch 20 and the hammer 14 is pushed into contact with the portion 18, thereby opening the valve 15. Compressed gas is now allowed to enter the space 16 and discharge the bullet 13.

According to the present invention, the pressure chamber 10 is in fluid connection with a larger chamber 30, referred to as a plenum. The plenum thus forms an extension of the pressure chamber, and the pressure in the plenum is also regulated by the regulator 9. The plenum 30 is formed around a rear portion of the barrel 3, coaxially surrounding the barrel 3.

In the illustrated example, the plenum 30 is formed by a sleeve 31 surrounding the barrel 3, and being sealed in each end by a front sealing 32 and a rear sealing 33. The rear sealing 33 is formed with a passage 34 providing a fluid connection between the coaxial plenum 30 and the pressure chamber 10.

The sleeve 30 and sealings 32, 33 are designed to withstand the regulated pressure. The walls of the sleeve 30 may therefore have a greater thickness than conventional barrel sleeves. As an example, the walls may have a thickness of around 3 mm.

It will be appreciated that the present invention is not limited to the embodiments shown. Several modifications and variations are thus conceivable within the scope of the invention which thus is exclusively defined by the appended claims.

What is claimed is:

1. A gas-powered gun for discharge of projectiles, comprising:

a barrel;

a pressure chamber for holding compressed gas;

a valve arranged to release compressed gas from the pressure chamber to thereby discharge a projectile provided in the barrel;

a plenum chamber in fluid connection with the pressure chamber; and a pressure regulator providing a controlled pressure in the pressure chamber and the plenum chamber, wherein the plenum chamber is formed around at least a rear portion of said barrel and is formed by a sleeve surrounding the barrel, said sleeve being sealed in a front end by a front sealing and in a rear end by a rear sealing, said rear sealing formed with a passage providing a fluid connection between the plenum chamber and the pressure chamber.

2. The gas-powered gun according to claim 1, wherein the pressure chamber is in fluid connection with a source of pressurized air via the pressure regulator.

3. The gas-powered gun according to claim 2, wherein the source of pressurized air is a bottle containing compressed air which has been fitted to the gas-powered gun.

4. The gas-powered gun according to claim 1, wherein the valve is an open-close valve that connects the pressure chamber to a space behind a firing position in the barrel.

5. The gas-powered gun according to claim 4, further comprising:

a trigger which is mechanically connected to a spring-loaded hammer that is configured to operate the open-close valve.

6. The gas-powered gun according to claim 5, wherein the hammer is biased towards the open-close valve by a biasing spring and is held against a force of the biasing spring by a catch, and wherein the trigger is operable to release the catch.

7. The gas-powered gun according to claim 1, further comprising:

a feeder pin arranged in a housing behind the barrel, said feeder pin being operable between (i) a rearwards position, in which the feeder pin allows a bullet to be inserted in a space in front of the feeder pin and (ii) a forwards position in which the feeder pin pushes the bullet into a firing position.

8. A gas-powered gun for discharge of projectiles, comprising:

a barrel;

a pressure chamber;

a valve arranged to release compressed gas from the pressure chamber to thereby discharge a projectile provided in the barrel;

a plenum chamber in fluid connection with the pressure chamber;

a pressure regulator providing a controlled pressure in the pressure chamber and the plenum chamber, and a passage between the pressure chamber and the plenum chamber, wherein the plenum chamber is an extension of the pressure chamber, and wherein the plenum chamber is formed by a sleeve surrounding the barrel, said sleeve being sealed in a front end by a front sealing and in a rear end by a rear sealing, said rear sealing formed with a passage providing a fluid connection between the plenum chamber and the pressure chamber.

9. The gas-powered gun according to claim 8, wherein the sleeve is arranged coaxially around the barrel.

10. The gas-powered gun according to claim 8, further comprising:

a source of pressurized air, wherein said source of pressurized air is a bottle containing compressed air which has been fitted to the gas-powered gun.

11. The gas-powered gun according to claim 8, wherein the valve is an open-close valve that connects the pressure chamber to a space immediately behind a firing position in the barrel.

12. The gas-powered gun according to claim 11, further comprising:

a trigger mechanically connected to a spring-loaded hammer, said hammer being configured to operate the open-close valve.

13. The gas-powered gun according to claim 12, wherein the spring-loaded hammer is biased towards the open-close valve by a biasing spring and is held against a force of the biasing spring by a catch, wherein the trigger is operable to release the catch.

14. The gas-powered gun according to claim 13, further comprising:

a feeder pin arranged in a housing behind the barrel, said feeder pin being operable between (i) a rearward position, in which the feeder pin allows a bullet to be inserted in a space in front of the feeder pin, and (ii) a forward position in which the feeder pin pushes the bullet into the firing position.

15. A gas-powered gun for discharge of projectiles, comprising:

a barrel;

a pressure chamber for holding compressed gas;

a plenum chamber in fluid connection with the pressure chamber;

a pressure regulator providing a controlled pressure in the pressure chamber and the plenum chamber, and a valve configured to release compressed gas from both the pressure chamber and the plenum chamber to thereby discharge a projectile provided in the barrel, wherein the plenum chamber is formed by a sleeve surrounding the barrel, said sleeve being sealed in a front end by a front sealing and in a rear end by a rear sealing, said rear sealing formed with a passage providing a fluid connection between the plenum chamber and the pressure chamber.

16. The gas-powered gun according to claim 15, wherein the sleeve is arranged coaxially around the barrel.

17. The gas-powered gun according to claim 15, further comprising:

a source of pressurized air, wherein said source of pressurized air is a bottle containing compressed air which has been fitted to the gas-powered gun.

18. The gas-powered gun according to claim 15, wherein the valve is an open-close valve that connects the pressure chamber to a space immediately behind a firing position in the barrel.

19. The gas-powered gun according to claim 18, further comprising:

a trigger mechanically connected to a spring-loaded hammer, said hammer being configured to operate the open-close valve, wherein the spring-loaded hammer is biased towards the open-close valve by a biasing spring and is held against a force of the biasing spring by a catch, wherein the trigger is operable to release the catch.

20. The gas-powered gun according to claim 19, further comprising:

a feeder pin arranged in a housing behind the barrel, said feeder pin being operable between (i) a rearward position, in which the feeder pin allows a bullet to be inserted in a space in front of the feeder pin, and (ii) a forward position in which the feeder pin pushes the bullet into the firing position.

* * * * *